US005123652A

United States Patent [19]

Oka

[11] Patent Number: 5,123,652

[45] Date of Patent: Jun. 23, 1992

[54] GOLF BALL

[75] Inventor: Kengo Oka, Kobe, Japan

[73] Assignee: Sumitomo Rubber Industries, Ltd., Hyogo, Japan

[21] Appl. No.: 691,500

[22] Filed: Apr. 25, 1991

[30] Foreign Application Priority Data

Nov. 7, 1990 [JP] Japan ..... 2-303081

[51] Int. Cl.[5] ..... A63B 37/14

[52] U.S. Cl. ..... 273/232

[58] Field of Search ..... 273/232

[56] References Cited

U.S. PATENT DOCUMENTS

| | | | |
|---|---|---|---|
| 4,813,677 | 3/1989 | Oka | 273/232 |
| 4,840,381 | 6/1989 | Ihara et al. | 273/232 |
| 4,848,766 | 7/1989 | Oka et al. | 273/232 |
| 5,024,444 | 6/1991 | Yamagishi et al. | 273/232 |

FOREIGN PATENT DOCUMENTS

| | | | |
|---|---|---|---|
| 2103939 | 3/1983 | United Kingdom | 273/232 |

*Primary Examiner*—Edward M. Coven
*Assistant Examiner*—Steven B. Wong
*Attorney, Agent, or Firm*—Birch, Stewart, Kolasch & Birch

[57] ABSTRACT

The present invention relates to a golf ball having dimples and a plurality of great circles unintersecting the dimples in which the specification of the dimples is set $1.02 \leqq VL/VF \leqq 1.20$ where L is a zone ranging from each of the great circles to each of the circumferences corresponding to a central angle of less than approximately 10°; F is a zone other than the L zone; the volume of each dimple arranged in the L zone is VL; and the volume of each dimple arranged in the F zone and having approximately the same diameter as that of said dimple arranged in the L zone is VF.

1 Claim, 4 Drawing Sheets

GOLF BALL

BACKGROUND OF THE INVENTION

1. Field of the Invention

The present invention relates to a golf ball, and more particularly, to the golf ball having no difference in its flight performance irrespective of the hitting position by a golf club. To this end, the aerodynamic symmetrical property of the golf ball is improved by improving the volumes of dimples in a zone in the vicinity of a great circle not intersecting dimples and in a zone other than the above-described zone.

2. Description of the Related Arts

Normally, 300 to 550 dimples are formed on the surface of a golf ball to improve the aerodynamic characteristic thereof and thereby increase the flight distance thereof. In order to arrange dimples on the surface of the golf ball symmetrically, various dimple arranging methods as described below using regular polyhedral dimple arrangement or semi-regular polyhedral arrangement have been proposed: Regular dodecahedral dimple arrangement disclosed in Examined Japanese Patent Publication No. 57-22595, regular octahedral arrangement disclosed in Japanese Patent Laid-Open Publication No. 60-111665, icosahedral-dodecahedral arrangement disclosed in Japanese Patent Laid-Open Publication No. 62-79073, and cubic octahedral arrangement disclosed in Japanese Patent Laid-Open Publication No. 1-221182. Golf balls having these dimple arrangement have a plurality of great circles not intersecting dimples. More specifically, 10 great circles are formed on the surface of a golf ball having regular dodecahedral arrangement; three great circles are formed on the surface of a golf ball having regular octahedral arrangement; six great circles are formed on the surface of a golf ball having regular icosahedral-dodecahedral arrangement; and four great circles are formed on the surface of a golf ball having regular cubic octahedral arrangement.

Normally, the golf ball is molded by a pair of upper and lower semispherical molds. Therefore, dimples cannot be arranged on the parting line on which the upper and lower molds contact with each other. In the above four dimple arrangements based on regular polyhedron and semiregular polyhedron, one of a plurality of great circles is on the parting line called the seam. The other great circles are geometrically equivalent to the seam and called semi-seams.

The golf balls rotates in its backspin when it is hit by a golf club. Preferably, the golf balls have no difference in each of trajectory height, duration of flight, and flight distance even though it rotates in its backspin about a different rotational axis. If the flight performance of the golf ball is varied due to a different hitting point, namely, due to the shift of a rotational axis, the golf ball cannot display a player's ability faithfully.

The method for hitting golf ball having the above regular polyhedral or semi-regular polyhedral dimple arrangement and a plurality of great circles is divided into the following three kinds owing to the shift of the rotational axis of the backspin caused by a varied hitting position:

Seam hitting: The golf ball is hit such that a circumference which rotates fastest in its backspin concides with the seam.

Semi-seam hitting: The golf ball is hit such that a circumference which rotates fastest in its backspin concides with the semi-seams.

Non-seam hitting: The golf ball is hit such that a circumference which rotates fastest in its backspin doesn't concide with the seam and the semi-seams.

In the golf ball having the regular polyhedral and semi-regular polyhedral dimple arrangement, the trajectory height in seam hitting and semi-seam hitting is lower than that in non-seam hitting, and the duration of flight in seam hitting and semi-seam hitting is shorter than that in non-seam hitting. This is because a great circle having no dimples arranged thereon rotates fastest in its backspin and consequently, the dimple effect of the golf ball in seam hitting and semi-seam hitting is not displayed as favorably as in non-seam hitting.

In order to improve the aerodynamic characteristic which is deteriorated owing to the difference in the hitting position of the golf ball caused by the existence of the seam, the present applicant proposed a dimple arrangement in Japanese Patent Laid-Open Publication No. 61-284264. According to this dimple arrangement, the volumes of dimples positioned in a zone in the vicinity of the seam are greater than those of dimples positioned in the other zone of the surface of the golf ball.

Applying this dimple arrangement to the golf ball having regular polyhedral and semi-regular polyhedral dimple arrangement, in seam hitting, all dimples positioned in the vicinity of the seam which rotates fastest in its backspin have greater volumes. Consequently, the golf ball has an improved dimple effect, thus having a trajectory similar to that in non-seam hitting.

However, in the golf ball in which the volumes of dimples positioned in the zone in the vicinity of the seam are greater than those of dimples positioned in the other zone, the trajectory in semi-seam hitting is lower than that in non-seam hitting and the duration of flight is shorter in semi-seam hitting than that in non-seam hitting. This is because in semi-seam hitting, dimples of greater volumes and smaller volumes are positioned in the vicinity of a semi-seam which rotates fastest in its backspin.

SUMMARY OF THE INVENTION

It is therefore the object of the present invention to eliminate the difference in trajectory heights between non-seam hitting and seam hitting as well as semi-seam hitting so as to provide a golf ball having a favorable aerodynamic symmetrical property.

In accomplishing these and other objects, the present invention provides a golf ball having dimples and a plurality of great circles unintersecting the dimples in which the specification of the dimples is set $$1.02 \leqq VL/VF \leqq 1.20$$

where L is a zone ranging from each of the great circles to each of the circumferences corresponding to a central angle of less than approximately 10° ; F is a zone other than the L zone; the volume of each dimple arranged in the L zone is VL; and the volume of each dimple arranged in the F zone and having approximately the same diameter as that of the dimple arranged in the L zone is VF.

According to the golf ball having regular polyhedral dimple arrangement or semi-polyhedral dimple arrangement and a plurality of great circles, the volume of a dimple arranged in the L zone, for example in the first row, adjacent to one of the great circles is greater than the volume of a dimple in F zone. The above dimple arrangement can compensate a reduced dimple effect due to the existence of the great circles. Therefore, the aerodynamic symmetrical property of the golf ball can be improved. That is, in seam hitting and semi-seam hitting, dimples in the vicinity of the circumference which rotates fastes in its backspin are in L zone. Thus, the dimple effect can be improved. Therefore, the trajectory height, duration of flight, and carry in seam hitting or semi-seam hitting are almost the same as those in non-seam hitting. That is, the golf ball in accordance with the present invention has a uniform flight performance irrespective of hitting position, namely, irrespective of seam hitting, semi-seam hitting, and non-seam hitting.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1A:
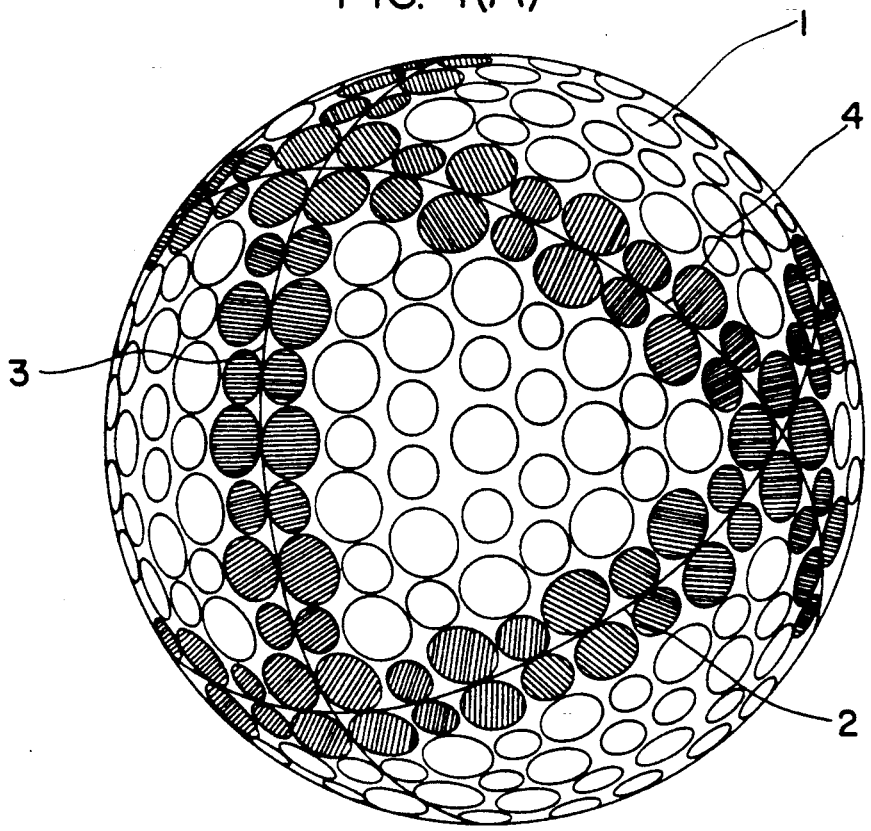
FIG. 1A is a perspective view showing a golf ball, in accordance with a first embodiment of the present invention, in which the surface is divided into an L zone and an F zone.

Before the description of the present invention proceeds, it is to be noted that like parts are designated by like reference numerals throughout the accompanying drawings.

Figure 1B:
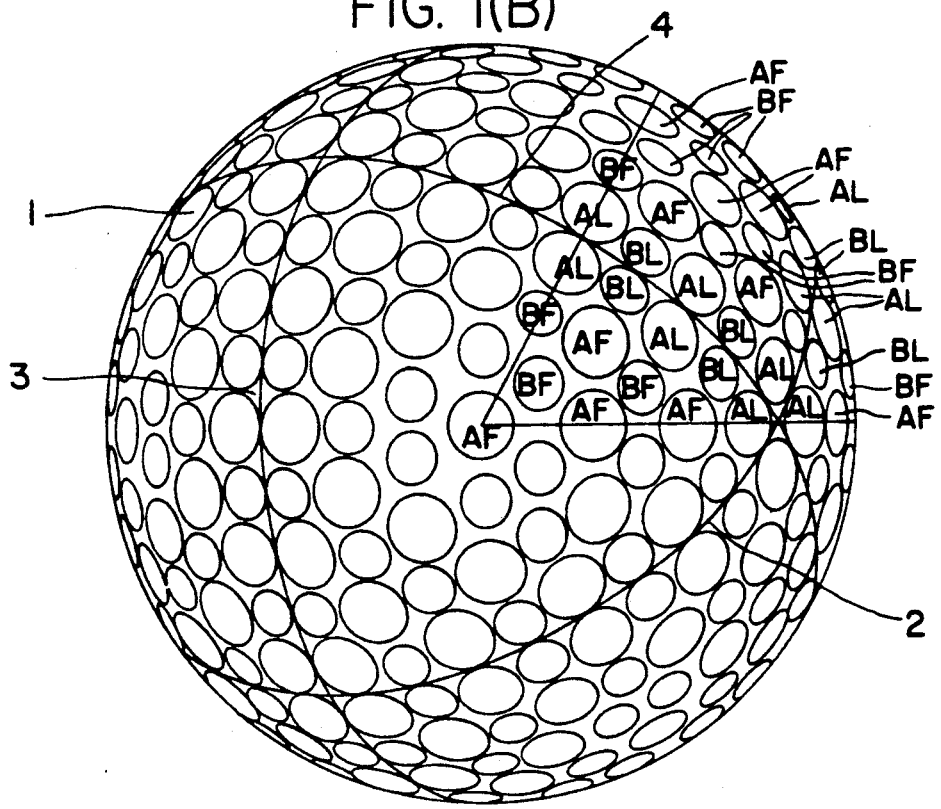
FIG. 1B is a perspective view showing the dimple arrangement of the golf ball in accordance with the first embodiment.

FIG. 1A and 1B show a golf ball according to a first embodiment of the present invention. The golf ball has a plurality of dimples 1 formed according to regular octahedral arrangement and three great circles 2, 3, and 4 not intersecting any of the dimples 1. The great circle 2 is the seam on the parting line and the great circles 3 and 4 are semi-seams. The golf ball is designed such that the width of the great circles 2, 3, and 4 is in the range from 0.2~0.6 mm. Each dimple 1 is circular and has a different curvature.

The surface of the golf ball is divided into an L spherical zone and an F spherical zone. L zone is adjacent to each of the great circles 2, 3, and 4. L zone ranges from each of the great circles 2, 3, and 4 to two circumferences formed in correspondence with a central angle of the golf ball of 8° with respect to each great circle. F zone is a zone other than the Z zone. Black dimples shown in FIG. 1A are arranged in L zone. That is, the center of each black dimple is in L zone. Similarly, the center of each of other dimples other the black dimples is in F zone.

Two kinds, namely, dimples of kind A and B are arranged in both L zone and F zone. The diameter of each dimple of kind A is 3.95 mm. The diameter of each dimple of kind B is 3.00 mm. Referring to FIG. 1B, AL denotes the dimple of kind A in L zone and AF denotes the dimple of kind A in F zone. Similarly, BL denotes the dimple of kind B in L zone and BF denotes the dimple of kind B in F zone. As shown in Table 1, although the dimples AL and AF are equal to each other in diameter, the depth of the dimple AL is greater than that of the dimple AF and the curvature of the former is smaller than that of the latter. Therefore, the volume of the dimple AL is greater than that of the dimple AF. Assuming that the volume of the dimple AL is VL and that of the dimple AF is VF, VL/VF=1.1.

Similarly, the depth of the dimple BL is greater than that of the dimple BF and the curvature of the former is smaller than that of the latter. Therefore, the volume of the dimple BL is greater than that of the dimple BF. Assuming that the volume of the dimple BL is VL and that of the dimple BF is VF, VL/VF=1.1.

TABLE 1

| | | | dimple Specification | | | | | |
|---|---|---|---|---|---|---|---|---|
| | total No. of dimples | kind of dimple | No. of dimples | dia. (mm) | depth (mm) | cruvature (mm) | vol. ($mm^3$) | total vol. ($mm^3$) |
| first E | 416 | AL | 96 | 3.95 | 0.172 | 11.39 | 1.06 | 328 |
| | | AF | 104 | 3.95 | 0.156 | 12.55 | 0.96 | |
| | | BL | 96 | 3.00 | 0.175 | 6.53 | 0.62 | |
| | | BF | 120 | 3.00 | 0.158 | 7.21 | 0.56 | |
| second E | 342 | AL | 48 | 3.93 | 0.176 | 11.01 | 1.07 | 330 |
| | | AF | 96 | 3.88 | 0.172 | 11.01 | 1.02 | |
| | | BL | 168 | 3.66 | 0.175 | 9.66 | 0.92 | |
| | | BF | 30 | 3.61 | 0.170 | 9.66 | 0.87 | |
| first C | 416 | A | 200 | 3.95 | 0.165 | 11.90 | 1.01 | 329 |
| | | B | 216 | 3.00 | 0.165 | 6.90 | 0.59 | |
| second C | 342 | AS | 54 | 3.93 | 0.176 | 11.01 | 1.07 | 329 |
| | | AP | 90 | 3.88 | 0.172 | 11.01 | 1.02 | |
| | | BS | 72 | 3.68 | 0.177 | 9.66 | 0.94 | |

TABLE 1-continued

| | | dimple Specification | | | | | |
|---|---|---|---|---|---|---|---|
| total No. of dimples | kind of dimple | No. of dimples | dia. (mm) | depth (mm) | cruvature (mm) | vol. ($mm^3$) | total vol. ($mm^3$) |
| | BP | 126 | 3.63 | 0.172 | 9.66 | 0.89 | |

E: embodiment,
C: comparison

Figure 2:
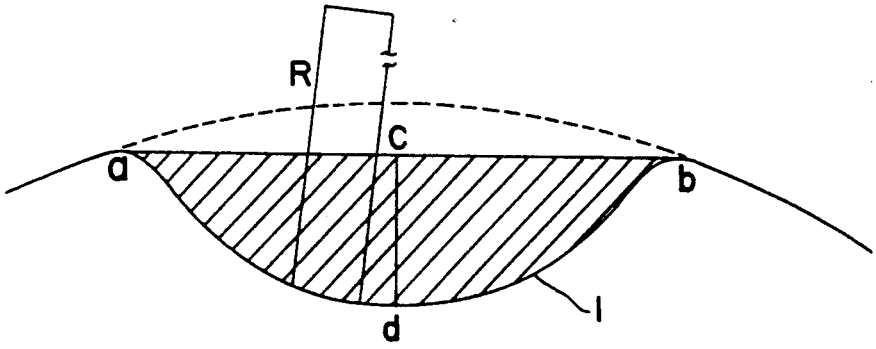
FIG. 2 is a schematic view showing the name of each portion of a dimple.

As shown in FIG. 2, diameter of the dimple is the length of a common tangent to both end points (a) and (b) of the dimple 1; depth is the length longest of perpendiculars dropped from the above tangent to the surface of the dimple, namely, the length from point (c) to (d); curvature is the radius (R) of a sphere, part of which forms the surface of the dimple 1.

As described above, according to the first embodiment, L zone and F zone are divided into each other by boundary lines which forms a central angle of 8° with respect to each of the great circles 2, 3, and 4. Preferably, the central angle is, however, in the vicinity of 10° selected from the range of 7° to 14°. More specifically, the central angle is set so that dimples in the first row adjacent to the great circle are arranged in L zone. If the central angle is much smaller than 10°, the number of the dimples AL and BL in L zone is too small, in which case, there is no significance in dividing the surface of the golf ball into L zone and F zone. In addition, the golf ball has no effect which is to be obtained by differentiating the dimple volumes. If the central angle is greater than 10°, the number of the dimples AL and BL in L zone is too many, in which case, the effect of L zone is much greater than that of F zone. Therefore, the aerodynamic symmetrical property of the golf ball cannot be improved. In addition, the central angle which determines the boundary line is selected in consideration of the dimple arrangement and construction of the golf ball and the mixing proportion of materials of the golf ball. That is, the area ratio between L zone and F zone and the volume ratio between dimple volumes VL and VF are selected so that the flight performance in seam hitting and semi-seam hitting is approximately equivalent to that in non-seam hitting. Seam hitting, semi-seam hitting, and non-seam hitting are described previously.

According to the first embodiment, the dimple volume is set so that the ratio of the dimple volume VL to the dimple volume VL is 1.1. However, VL/VF may be set as follows:

$$1.02 \leqq VL/VF \leqq 1.20$$

If VL/VF is less than 1.02, the dimple effect in semi-seam hitting and seam hitting cannot be improved to a great extent. If VL/VF is more than 1.20, the dimple effect becomes too great, in which case, the trajectory in semi-seam hitting and seam-hitting is higher than that in non-seam hitting.

Figure 3A:
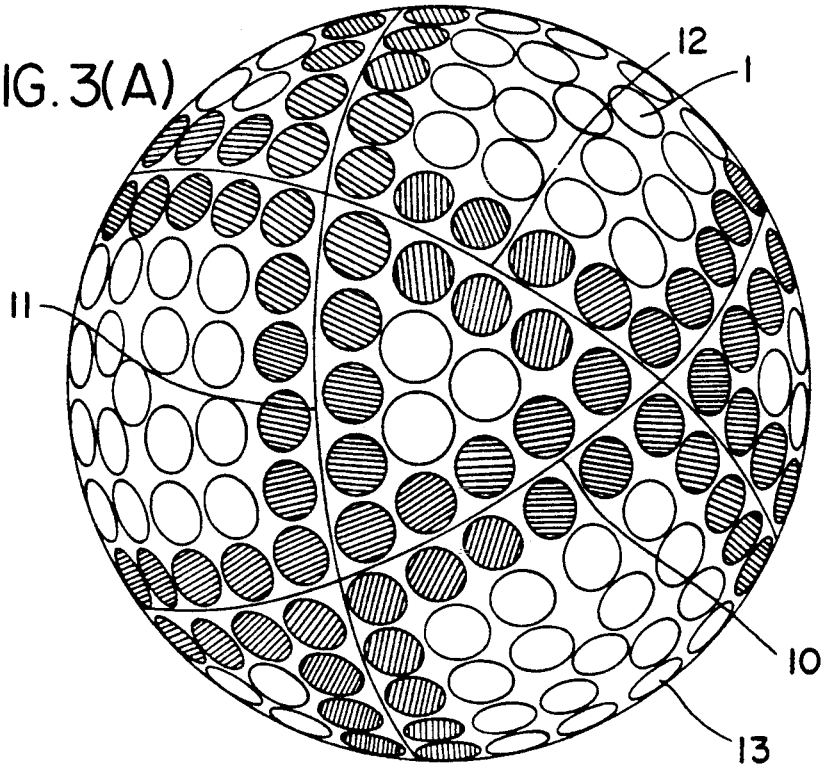
FIG. 3A is a perspective view showing a golf ball, in accordance with a second embodiment of the present invention, in which the surface is divided into an L zone and an F zone.
Figure 3B:
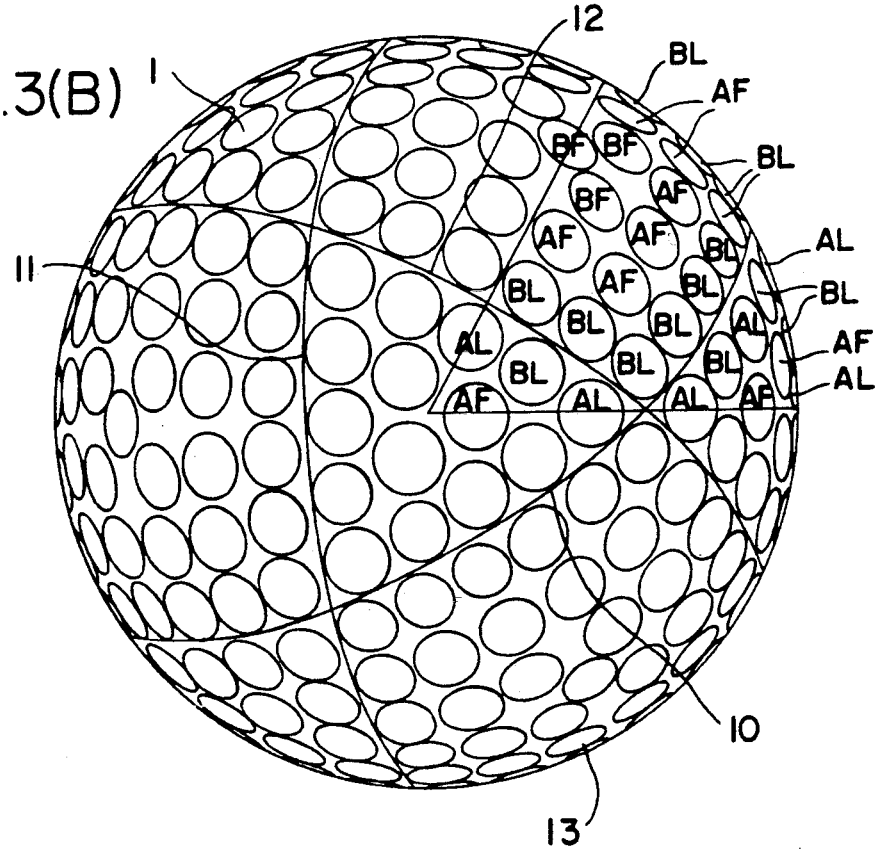
FIG. 3B is a schematic view showing the dimple arrangement of the golf ball in accordance with the second embodiment.

FIG. 3A and 3B show a golf ball according to a second embodiment of the present invention. The golf ball has cubic octahedral dimple arrangement, thus having four great circles 10, 11, 12, and 13. According to the second embodiment, the central angle is set to 13° so that the spherical surface of the golf ball is divided into L zone adjacent to each great circle and F zone. Black dimples shown in FIG. 3A are arranged in L zone. Both L and F zones have two kinds of dimples, namely, kind A approximately 3.90 mm in diameter and kind B approximately 3.65 mm in diameter. The dimple of kind A arranged in L zone is greater in depth and slightly greater in diameter than the dimple of kind A arranged in F zone so that the volume VL of the dimple AL is greater than the volume VF of the dimple AF. More specifically, the ratio of the volume VL of the dimple AL to the volume VF of the dimple AF is 1.05. Similarly, the ratio of the volume VL of the dimple BL to the volume VF of the dimple BF is also 1.05.

According to the first and second embodiments, the volume of the dimple in L zone adjacent to the seam or the semi-seams equivalent to the seam is greater than that of the dimple in F zone. Needless to say, the aerodynamic symmetrical property of the golf ball having a great circle unequivalent to the seam can be also improved by arranging dimples such that the volume of the dimple in L zone is greater than that of the dimple in F zone.

In order to examine the operation and effect of the aerodynamic symmetrical property of the golf ball in accordance with the present invention, first and second comparison golf balls having specification as shown in Table 1 are prepared for comparison with the golf balls according to the first and second embodiments.

Figure 4:
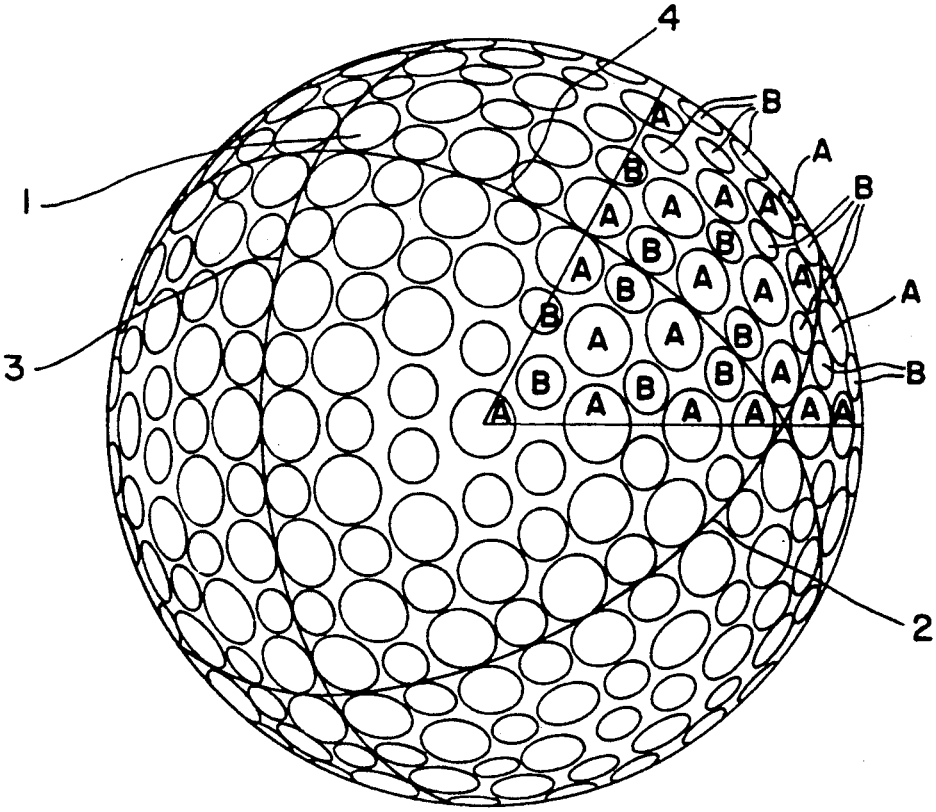
FIG. 4 is a perspective view showing the dimple arrangement of a first comparison golf ball.

The first comparison golf ball as shown in FIG. 4 has also regular octahedral dimple arrangement and three great circles 2, 3, and 4. The position of each dimple 1 and the diameter thereof are the same as those of the golf ball according to the first embodiment. Unlike the golf ball of the first embodiment, the surface of the first comparison golf ball is not divided into L zone and F zone. That is, 3.95 mm-diameter dimple of kind A and 3.00 m-diameter dimple of kind B have the same depth, curvature, and volume.

Figure 5A:
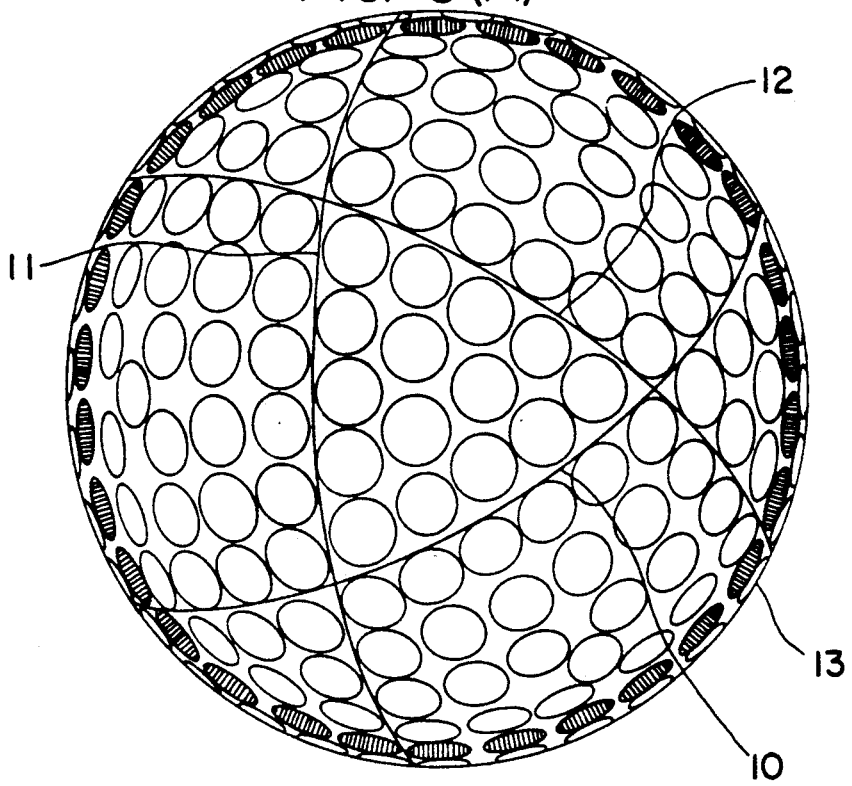
FIG. 5A is a perspective view showing a second comparison golf ball in which the surface is divided into an S zone and a P zone.
Figure 5B:
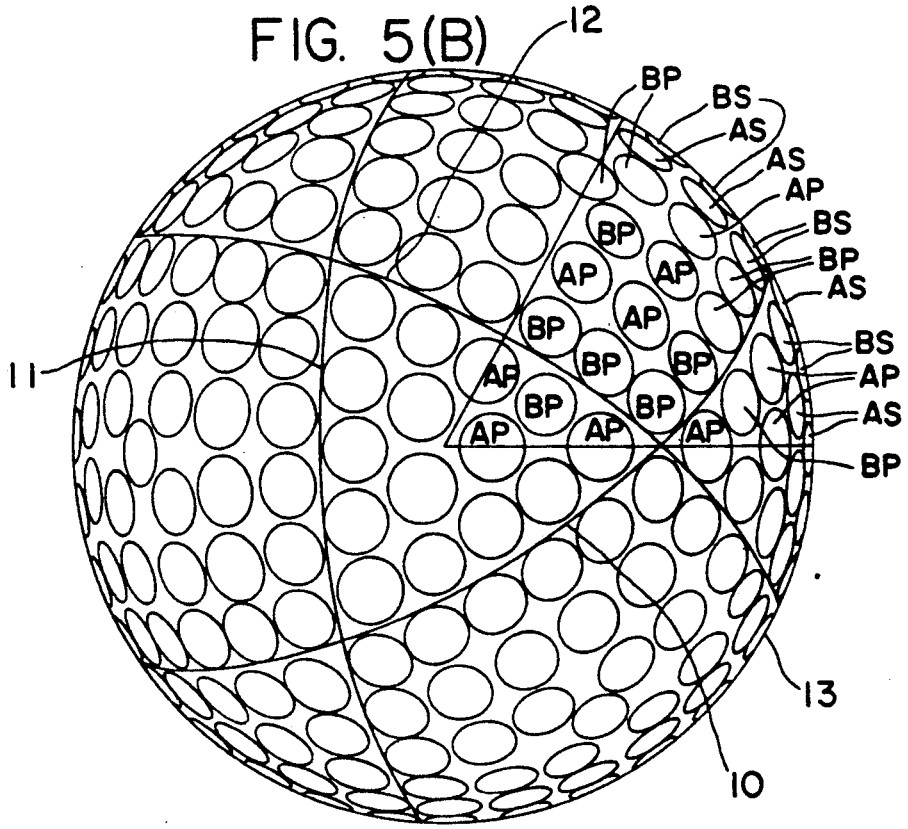
FIG. 5B is a perspective view showing the dimple arrangement of the second comparison golf ball.

A second comparison golf ball as shown in FIGS. 5A and 5B has cubic octahedral dimple arrangement similarly to the golf ball of the second embodiment and four great circles 10, 11, 12, and 13. The position of each dimple 1 is identical to that of the dimple according to the second embodiment. The dimple arrangement of the second comparison golf ball is based on the dimple arrangement of Japanese Patent Laid-Open Publication No. 61-284264. That is, the volume of the dimple in a zone adjacent to a great circle 10 corresponding to the seam is greater than that of the dimple in the other zone. More specifically, the surface of the golf ball is divided into S zone and P zone. S zone ranges from the great circle 10 to each of the circumferences corresponding to a central angle of less than 30°. P zone is the area other than S zone. Black dimples shown in FIG. 5A are arranged in S zone and other dimples are arranged in P zone. The diameter and depth of a dimple AS (kind A) arranged in S zone and having a diameter of approximately 3.90 mm are greater than those of a dimple AP (kind A) as shown in Table 1. Therefore, the volume of the dimple AS is greater than that of the dimple AP. The ratio of the volume of the dimple AS to that of the dimple AP is 1.05. Similarly, the kind B of dimple having the diameter of 3.65 mm, the volume of the dimple BS arranged in S zone is greater than that of the dimple BP arranged in P zone. The ratio of the volume of the dimple BS to that of the dimple BP is 1.05.

The golf balls of the first and second embodiment, the first and second comparison golf balls comprise thread wound around a liquid center and a balata cover, and have the same construction composed of materials of the same mixing proportion. The outer diameter are each 42.70±0.03 mm and the compression are each 95±2.

Experiment

Symmetrical property tests were conducted on the golf balls of the first and second embodiments and the first and second comparison golf balls using a swing robot manufactured by True Temper Corp. The golf balls were hit by a driver (No. 1 wood) at a head speed of 458.8 m/s, at a spin of 3500±300 rpm, and a launching angle of 9±0.5°. The wind was fair at a speed of 0.5~3.2 m/s. The number of golf balls of the first embodiment, second embodiment, the first comparison, and second comparison was 60, respectively. Temperatures of the golf balls were kept at 23° C.±1° C.

Of 60 test balls of each of the first and second embodiments, 20 golf balls were used each for seam hitting, semi-seam hitting, and non-seam hitting. Similarly, of 60 test balls of each of the first and second comparison examples, 20 golf balls were used each for seam hitting, semi-seam hitting, and non-seam hitting.

Carry, trajectory height (angle of elevation viewed from a launching point of golf ball to the highest point thereof in trajectory), and duration of flight were measured to test the symmetrical property of each golf ball. The average value of the carries, trajectory heights, and flight durations are shown in Table 2.

TABLE 2

| | Symmetrical property test | | | |
|---|---|---|---|---|
| | kind of hitting | carry (yard) | trajectory height (DEG) | duration of flight (SEC) |
| first E | seam | 244.0 | 13.35 | 5.88 |
| | semi-seam | 244.0 | 13.37 | 5.91 |
| | non-seam | 244.7 | 13.41 | 5.92 |
| second E | seam | 248.5 | 13.67 | 6.18 |
| | semi-seam | 248.8 | 13.69 | 6.17 |
| | non-seam | 249.2 | 13.72 | 6.22 |
| first C | seam | 238.9 | 13.02 | 5.59 |
| | semi-seam | 240.3 | 13.09 | 5.66 |
| | non-seam | 245.2 | 13.46 | 5.97 |
| second C | seam | 249.6 | 13.73 | 6.14 |
| | semi-seam | 243.7 | 13.37 | 5.89 |
| | non-seam | 250.5 | 13.83 | 6.25 |

E: embodiment,
C: comparison

As shown in Table 2, golf balls of the first and second embodiments had smaller differences than the comparison golf balls in the carry, trajectory height, and duration of flight between seam hitting, half-seam hitting, and non-seam hitting According to the first comparison golf balls, the trajectory height in seam hitting and semi-seam hitting is lower and the carry as well as the duration of flight in seam hitting and semi-seam hitting were shorter than that in non-seam hitting. This is because the dimple effect in seam hitting and semi-seam hitting is smaller than that in non-seam hitting. According to the second comparison golf ball, the dimple effect in seam hitting is improved because the volume of the dimple in the vicinity of the seam is greater than the volume of the dimple in the other zone. Consequently, the trajectory height, duration of flight, and carry in seam hitting are equal to those in non-seam hitting. However, the trajectory height in semi-seam hitting is lower and the carry as well as the duration of flight in semi-seam hitting were shorter than those in seam hitting and non-seam hitting. This is because the dimple effect in semi-seam hitting is smaller than that in seam hitting and non-seam hitting.

That is, the aerodynamic symmetrical property of the golf balls of the first and second embodiments are more favorable than that of the first and second comparison golf balls. Therefore, according to the present invention, the difference in trajectory height of the golf ball due to the difference of the rotational axis in backspin is smaller than than that of the first and second comparison golf balls, thus the aerodynamic symmetrical property of the golf ball is improved.

As apparent from the foregoing description, since the volume of the dimple in the zone adjacent to each of a plurality of great circles is greater than the dimple in the other zone, the dimple effect of the zone adjacent to each of the great circles can be improved. Therefore, the aerodynamic symmetrical property of the golf ball of the present invention is much more favorable than that of conventional golf balls. That is, the difference in the trajectory height of the golf ball owing to the rotational axis thereof is small. The golf ball can reflect a player's ability faithfully.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball having dimples and a plurality of great circles unintersecting said dimples on a spherical surface thereof, and characterized in that the specification of said dimples is set $1.02 \leqq VL/VF \leqq 1.20$ where L is a zone ranging from each of said great circles to each of the circumferences corresponding to a central angle of less than approximately 10°; F is a zone other than said L zone; the volume of each dimple arranged in said L zone is VL; and the volume of each dimple arranged in said F zone and having approximately the same diameter as that of said dimple arranged in said L zone is VF.

* * * * *